US012000393B2

(12) United States Patent
Dellweg et al.

(10) Patent No.: US 12,000,393 B2
(45) Date of Patent: Jun. 4, 2024

(54) THRUST PLATE FOR REDUCING CONTACT STRESS IN A SCROLL COMPRESSOR

(71) Applicant: Copeland Europe GmbH, Berlin (DE)

(72) Inventors: Linus Dellweg, Welkenraedt (BE); Xiaogeng Su, Welkenraedt (BE); Geoffrey Bailly, Welkenraedt (BE); Jesús Ángel Nohales Herraiz, Welkenraedt (BE); Sheng Liang, Welkenraedt (BE)

(73) Assignee: Copeland Europe GmbH, Berlin (DE)

( * ) Notice: Subject to any disclaimer, the term of this patent is extended or adjusted under 35 U.S.C. 154(b) by 0 days.

(21) Appl. No.: 17/848,362

(22) Filed: Jun. 23, 2022

(65) Prior Publication Data

US 2022/0412354 A1 Dec. 29, 2022

(30) Foreign Application Priority Data

Jun. 23, 2021 (EP) ..... 21181138

(51) Int. Cl.

| | |
|---|---|
| ***F04C 29/00*** | (2006.01) |
| ***F01C 17/06*** | (2006.01) |
| ***F04C 18/02*** | (2006.01) |
| ***F04C 29/02*** | (2006.01) |
| *F04C 23/00* | (2006.01) |

(52) U.S. Cl.

CPC ..... *F04C 18/0215* (2013.01); *F04C 29/0021* (2013.01); *F04C 23/008* (2013.01); *F04C 2240/801* (2013.01)

(58) Field of Classification Search

CPC ..... F04C 18/0215; F04C 18/0253; F04C 29/001; F04C 29/028; F01C 17/066

See application file for complete search history.

(56) References Cited

U.S. PATENT DOCUMENTS

| | | | |
|---|---|---|---|
| 6,190,148 | B1 | 2/2001 | Ni |
| 8,182,249 | B2 | 5/2012 | Sugimoto et al. |
| 2008/0050260 | A1 | 2/2008 | Iwanami et al. |

(Continued)

FOREIGN PATENT DOCUMENTS

| | | | | |
|---|---|---|---|---|
| JP | H0216381 A | * | 1/1990 | ..... F04C 18/02 |
| JP | 2005315167 A | * | 11/2005 | |

OTHER PUBLICATIONS

English translation of JP 2005315167 by PE2E, Oct. 13, 2022.*

(Continued)

*Primary Examiner* — Deming Wan

(74) *Attorney, Agent, or Firm* — Harness, Dickey & Pierce, P.L.C.

(57) ABSTRACT

A thrust plate for use in a scroll compressor is described. The thrust plate comprises a disk-shaped body defining a plane and having a first side and a second side, wherein the second side opposes the first side, at least one protrusion extending from the first side, and at least one recess located at the second side, wherein the at least one protrusion and the at least one recess overlap at least partially in a direction perpendicular to the plane. Further, a system is described, wherein the system comprises a thrust plate with at least one protrusion and an orbiting scroll plate with at least one recess, wherein the at least one protrusion and the at least one recess overlap. Also, a scroll compressor having either a corresponding thrust plate or a corresponding system is described.

13 Claims, 12 Drawing Sheets

(56) References Cited

U.S. PATENT DOCUMENTS

2013/0323105 A1* 12/2013 Chao ..... F04C 23/008
418/55.6
2019/0308351 A1* 10/2019 Fukuzawa ..... F16H 57/08

OTHER PUBLICATIONS

JPH0216381 by PE2E Jan. 18, 2023.*
Extended European Search Report issued in corresponding Application No. 21181138.5 dated Dec. 17, 2021.

* cited by examiner

THRUST PLATE FOR REDUCING CONTACT STRESS IN A SCROLL COMPRESSOR

CROSS-REFERENCE TO RELATED APPLICATIONS

This application claims priority to European Application No. 21181138.5 filed Jun. 23, 2021, the entire disclosure of which is incorporated herein by reference.

FIELD

The current application relates to reducing contact stress in a scroll compressor, wherein such compressor could be used, for example, in refrigeration systems.

BACKGROUND

A compressor is an apparatus, which reduces the volume of a fluid by increasing the pressure of the fluid. In most common applications, the fluid is a gas.

Compressors are used, for example, in refrigeration systems. In a common refrigeration system, a refrigerant is circulated through a refrigeration cycle. Upon circulation, the refrigerant undergoes changes in thermodynamic properties in different parts of the refrigeration system and transports heat from one part of the refrigeration system to another part of the refrigeration system. The refrigerant is a fluid, i.e. a liquid or a vapour or gas. Examples of refrigerants may be artificial refrigerants like fluorocarbons. However, in recent applications, the use of carbon dioxide, $CO_2$, which is a non-artificial refrigerant, has become more and more important, because it is non-hazardous to the environment.

In general, a compressor receives cool refrigerant at a suction port, compresses said refrigerant in a means for compressing and provides the compressed refrigerant to the refrigeration cycle at a discharge port. Compressing the refrigerant in the means for compressing reduces the volume of the refrigerant, while increasing its pressure and temperature.

In a scroll compressor, the means for compressing is formed by a scroll set, which comprises scroll plates, typically a stationary scroll plate and an orbiting scroll plate. Each of these scroll plates has a base plate and a protrusion in form of a spiral wrap, which extends from the base plate. In the assembled scroll compressor, the protrusions are interleaved, so that when the orbiting scroll plate moves relatively to the stationary scroll plate, refrigerant received from the suction port will be enclosed between the base plates and the interleaved protrusions. During the relative motion, the refrigerant will be moved within the interleaved protrusions towards the center of the scroll plates, i.e. the center of the protrusions. Thereby, the refrigerant will be compressed. When the compressed refrigerant reaches the center of the scroll plates, the compressed refrigerant can be ejected from the scroll set through an opening in the base plate of the stationary scroll plate.

The compression of the refrigerant increases the pressure of the refrigerant inside the scroll set. This pressure acts on the scroll plates and creates a force, which pushes the stationary scroll plate and the orbiting scroll plate away from each other. For proper operation, the stationary scroll plate is fixed to a portion of a case the scroll compressor, while the orbiting scroll plate is supported on its backside by ease of a frame. In this regard, the backside refers to the side, which faces away from the stationary scroll plate. Thereby, the orbiting scroll plate is tightly secured in engagement with the stationary scroll plate.

However, the forces created by the high pressure causes contact stress between the orbiting scroll plate and the supporting frame. The higher the pressure rises, the higher the forces and the higher the contact stress, because the orbiting scroll plate will be pushed against the supporting frame.

Further, motion of the orbiting scroll plate causes wear at the frame, which increases when the pressure of the compressed refrigerant and thereby the forces, which push the scroll plates away from each other, increase. In particular in $CO_2$ compressors, where refrigerant is compressed at a high pressure, substantial contact stress and wear occur, which reduce the lifetime of the scroll compressor.

Hence, there is a need in the art for reducing contact stress and wear in a scroll compressor and increasing the lifetime of the scroll compressor.

The above-mentioned need is fulfilled by a thrust plate according to the current invention, wherein the thrust plate is configured to be used in a scroll compressor.

SUMMARY

The thrust plate is configured to be placed between an orbiting scroll plate and a frame, which supports the orbiting scroll plate. The frame is either a portion of a case of the scroll compressor or it is a component connected to the frame. Preferably, the frame is static during the operation of the scroll compressor.

The thrust plate comprises a disk-shaped body, which defines a plane. Further, the disk-shaped body has a first side and a second side, which opposes the first side. The first and second sides may also be referred to as bottom side and top side of the disk-shaped body. One or both sides may comprise a surface, which is essentially parallel to the plane defined by the disk-shaped body. When the thrust plate is assembled in a scroll compressor, the first side faces the frame and the second side faces the orbiting scroll plate.

The first side comprises at least one protrusion. The at least one protrusion extends from the first side. The at least one protrusion may extend from a surface of the first side of the disk-shaped body. The at least one protrusion may extend essentially perpendicular to said plane defined by the disk-shaped body. In this regard, the term "essentially perpendicular" means that the direction in which the at least one protrusion extends from the first side is a three-dimensional direction, which has at least one component, which is parallel to the perpendicular direction, and said at least one component is larger than the other two components. In other words, the at least one protrusion extends away from the surface of the first side, but the angle, which defines the direction of the extend with respect to the plane does not need to be precisely 90 degrees.

The at least one protrusion may have a shape of a bar, a pillar, a cylinder, a truncated cone, a truncated pyramid, or generally any arbitrary shape. The arbitrary shape may form a pattern. Thereby, the protrusion may have a tangled or labyrinthine shape. Also, two or more protrusions may be arranged on the first side in form of a pattern or in any arbitrary arrangement. If the first side comprises two or more protrusions, the two or more protrusions do not need to have the same shape. Instead, each protrusion may have any of the aforementioned shapes.

The second side comprises at least one recess. The recess is located at the second side. For example, the recess may be located at a surface of the second side or the recess may also be located beneath the surface of the second side.

A recess according to the current invention may be defined by setting back a portion of a surface. A recess may be defined by a bottom and a plurality of side walls. The bottom limits the depth of the recess and the side walls limit the extend of the recess to the sides. Although a portion of a recess may be located at an edge of the thrust plate, it is preferred that the recess comprises at least two side walls. The two side walls may be located at opposing sides.

The at least one recess may, for example, be one of a groove, a slot, a cavity or may have any arbitrary shape. The arbitrary shape may form a pattern. Thereby, a single recess may form a tangled or labyrinthine shape. Also, two or more recesses may be arranged on the second side in form of a pattern or in any arbitrary arrangement. For example, a pattern may be formed by connecting two or more arbitrarily shaped recesses. If the second side comprises two or more recesses, the two or more recesses do not need to have the same shape. Instead, each recess may have any of the aforementioned shapes.

According to the current invention, the at least one protrusion and the at least one recess are arranged on the respective first and second sides of the disk-shaped body in a way that the at least one protrusion and the at least one recess overlap at least partially in a direction perpendicular to the plane defined by the disk-shaped body. For example, the overlap may be defined based on a projection of the geometric shapes of the at least one protrusion and the at least one recess into the plane. The projection may occur at a direction perpendicular to the plane. In this regard, said plane may be referred to as projection plane. Throughout this description, a projection is to be interpreted as a projection along a direction perpendicular to said projection plane into said projection plane, unless it is clearly stated otherwise. The area of the projection of the at least one protrusion or the at least one recess into the projection plane may also be referred to as ground area.

In other words, the locations of the at least one protrusion and the at least one recess on the respective first and second sides are arranged such that the at least one protrusion and the at least one recess are located at least partially below or beneath each other.

Providing at least one protrusion at a first side of the thrust plate and at least one recess at a second side of the thrust plate in overlapping locations reduces the contact stress caused by the increased pressure of the refrigerant and the wear caused by the orbiting motion of the orbiting scroll plate.

In the assembled scroll compressor, the thrust plate is located between the backside of the orbiting scroll plate and the frame. Thereby, the thrust plate provides support for the orbiting scroll plate and counteracts the forces, which act on the orbiting scroll plate during compression of the refrigerant and forces the orbiting scroll plate away from the stationary scroll plate. As such, the thrust plate will be squeezed between the backside of the orbiting scroll plate and the supporting frame. This aspect will be more readily appreciated when it will be described with reference to the appended drawings below, in particular FIG. 3*a*. Thereby, the at least one protrusion at the first side of the thrust plate will contact the supporting frame and the surface of the second side of the thrust plate will contact the backside of the orbiting scroll plate in the assembled scroll compressor. Because the at least one protrusion at the first side of the thrust plate overlaps with the at least one recess at the second side, the thrust plate will not provide hard contact between the orbiting scroll plate and the thrust plate, but instead a rather soft contact, since the thrust plate can be slightly deformed by the acting forces. As such, the thrust plate can act as a cushion between the orbiting scroll plate and the frame. The deformation that may occur because of soft contact may be approximately 100 μm or less.

Furthermore, since the orbiting scroll side is driven by the engagement with the crankshaft on its backside and the pressure within the compression chamber formed at its frontside changes during operation, there is an offset between the forces acting on the orbiting scroll plate. In consequence, the orbiting scroll plate may tend to wobble or tilt during operation, as will be further described with respect to FIG. 3*b*. Such wobbling or tilting results in unevenly distributed stress on the support of the orbiting scroll plate. In particular when there is hard contact between the orbiting scroll plate and its support, load on the support and therefore stress is concentrated locally. Using a thrust plate according to the current invention provides a softer contact and therefore has the further advantage that locally concentrated stress caused by wobbling or tilting of the orbiting scroll plate is reduced because the softer contact allows for a more evenly distributed stress. For example, because of the soft contact, the thrust plate can be deformed by the stress, which leads to a larger contact area between the orbiting scroll plate and the thrust plate.

In the following, further preferred embodiments of the current invention are described.

In some preferred embodiments, the disk-shaped body may comprise a plurality of holes, which extend through the disk-shaped body. These holes may be configured to receive pins from an Oldham coupling. In such a configuration, the Oldham coupling, which is usually necessary to guide the orbiting motion of the orbiting scroll plate and prevent the orbiting scroll plate from rotating, can, for example, be placed behind the thrust plate or around the at least one protrusion at the first side of the thrust plate. Accordingly, compared to a configuration in which the Oldham coupling is placed around the outer circumference of the thrust plate, the surface of the second side of the thrust plate can be increased. This means that the Oldham coupling may, for example, be placed in clearances around the protrusions of the thrust plate. Increasing the second surface, i.e. the surface, which contacts the backside of the orbiting scroll, allows to distribute load over a larger surface area, thereby reducing the wear at any point locally.

In some preferred embodiments, the disk-shaped body may comprise an aperture, which extends from a surface of the first side to a surface of the second side. The aperture may be configured to receive a portion of a crankshaft. Thereby, in the assembled scroll compressor, the portion of the crankshaft may pass through the thrust plate and may be received from an orbiting scroll plate. The aperture may have a diameter, which is greater than the diameter of the portion of the crankshaft, so that there does not need to be contact between the thrust plate and the crankshaft. In some configurations, the aperture may also be configured to—additionally or alternatively—receive a portion of an orbiting scroll plate. For example, a portion of the crankshaft may extend through the aperture of the disk-shaped body. Alternatively, a portion of the orbiting scroll plate may extend through the aperture of the disk-shaped body. However, it is also possible that a portion of the crankshaft and a portion of the orbiting scroll plate each extend at least partially into the aperture and engage each other. The engaging portions of the orbiting scroll plate and the crankshaft may then be located at least partially within the aperture of the disk-shaped body of the thrust plate. As before, the diameter of the aperture may be greater than the diameter of the portion of the orbiting scroll plate.

In some preferred embodiments, the at least one protrusion may overlap entirely with the at least one recess. This means that there is no portion of the at least one protrusion, which does not overlap with the at least one recess, while there may be a portion of the at least one recess, which does not overlap with a portion of the at least one protrusion. In other words, the size of the ground area of the at least one protrusion may be smaller or equal to the size of the ground area of the at least one recess. Further, in case of equal size, it may be the case that there is no portion of the at least one protrusion, which does not overlap with the at least one recess and that there is no portion of the at least one recess, which does not overlap with the at least one protrusion.

If the ground area of the at least one recess is larger—in other words, a portion of the at least one recess does not overlap with any portion of at least one protrusion—, than the recess may extend outwardly in any direction parallel to the plane. Said directions parallel to the plane may also be referred to as in-plane directions. Usually, it is preferred that the ground area of the at least one recess is larger compared to the ground area of the at least one protrusion, so that a buffer or transition region is added, which improves elasticity or deformation behavior of the thrust plate. For example, the ground area of the at least one recess may preferably extend 1 to 2 mm further than the ground area of the at least one protrusion in any in-plane direction. Although it is preferred that the ground area of the at least one recess is larger than the ground area of the at least one protrusion, it is not necessarily the case for all embodiments. In some embodiments, the ground areas may have the same overlapping size, while in other embodiments the ground area of the at least one protrusion is larger.

In some preferred embodiments, the first side may comprise two or more protrusions. In some preferred embodiments, each of the two or more protrusions may overlap entirely with at least a portion of the at least one recess. Thereby, providing multiple protrusions at the first side of the disk-shaped body may improve the load balancing on the supporting frame and thereby reduce the contact stress and wear by distributing the forces over several locations. In some further preferred examples, the second side may comprise two or more recesses and the two or more protrusions may overlap with the two or more recesses. For example, each one of the two or more protrusions may overlap with one of the two or more recesses.

In some preferred embodiments, the at least one protrusion and the at least one recess may form first and second patterns, respectively. Then, the first pattern may overlap at least partially with the second pattern. Said patterns may overlap entirely or the size of either the first pattern or the second pattern with respect to the plane may be larger. In case of the size of one pattern being larger, the at least one protrusion or at least one recess forming the pattern may preferably extend 1 to 2 mm outwardly in every in-plane direction in order to add a buffer or transition region.

Such specifically designed patterns may provide a compromise between, on the one hand, large contact surface between the surface of the second side of the thrust plate and the backside of the orbiting scroll plate and, on the other hand, sufficient stability of the thrust plate achieved by contact between the one or more protrusions of the thrust plate and the supporting frame, while avoiding any hard contacts according to the definition given earlier.

In some preferred embodiments, the at least one protrusion and/or the at least one recess may have an annular shape. If the first side comprises two or more protrusions having annular shapes, the two or more protrusions may form concentric rings. Similarly, if the second side comprises two or more recesses having annular shapes, they may form concentric rings. If both the at least one protrusion and the at least one recess have annular shapes, they may form concentric rings. When the two or more protrusions form concentric rings, this may be achieved by their cross-sections, which are parallel to the plane, forming concentric rings. The same is applicable for the two or more recesses. Also, the cross-sections of the protrusions and the recesses may form concentric rings.

In some preferred embodiments, each of the at least one protrusion may be formed by a bar, which may extend radially from a center of disk-shaped body. Each of the at least one recess may be formed by a groove, which may extend radially from the center of the disk-shaped body. In a preferred embodiment, there may be a plurality of protrusions formed by a plurality of bars and a plurality of recesses formed by a plurality of grooves. The number of the plurality of bars and the number of the plurality of grooves may be the same, but it may also be possible that two or more bars overlap with the same groove, such that the number of grooves may be less than the number of bars. Generally, each groove may have a larger width than the corresponding bar. However, if there is more than one groove and/or more than one bar, it is not necessary that the all grooves have the same width, just like it is not necessary that all the bars have the same width. Such an arrangement of radial extending bars and grooves may distribute the wear in a preferred way.

In some preferred embodiments, the body of the thrust plate may be integrally formed. In some other preferred embodiments, the body of the thrust plate may be formed from multiple parts, which are assembled. For example, the first side may be formed by a first part of the body of the thrust plate and the second side may be formed by a second part of the body of the thrust plate. The first part and the second part may be stacked together. Such a thrust plate formed from multiple parts may provide the same benefits but may be more easily manufactured.

In some preferred embodiments, the thrust plate may be formed as an integral portion of the frame, which is connected to the case of the compressor in order to provide support for the orbiting scroll plate. Such embodiments may provide improved stability of the assembled scroll compressor.

The abovementioned preferred embodiments are not mutually exclusive. This means that features described for some preferred embodiments may also be utilized in some other preferred embodiments unless it is clear from the description that these features cannot be combined.

The above-mentioned need is also fulfilled by a system comprising a thrust plate and an orbiting scroll plate. The thrust plate according to the system comprises a disk-shaped body, which defines a plane and which has a first side and a second side. The second side opposes the first side and at least one protrusion extends from the first side. The orbiting scroll plate has a base plate with a frontside and a backside. The frontside may comprise a spiral wrap for being interleaved with a corresponding spiral wrap of another scroll plate in a scroll compressor. The orbiting scroll plate comprises at least one recess located at the backside of the base plate of the orbiting scroll plate. The at least one protrusion and the at least one recess overlap at least partially in a direction perpendicular to the plane. The backside of the orbiting scroll plate at least partially abuts at least a portion of the second side of the thrust plate. As such, the thrust plate and the orbiting scroll plate may be assembled in a scroll compressor in a way that they are in contact to one another. For example, the orbiting scroll plate may be placed above the thrust plate, such that the thrust plate supports the backside of the orbiting scroll plate.

The at least one protrusion and the at least one recess as well as their overlap may be similar to the at least one protrusion and the at least one recess and their overlap as described for the aforementioned thrust plate embodiment example. In other words: in the thrust plate embodiment, hard contact is avoided by providing at least one protrusion and at least one recess at corresponding locations on opposing sides of the thrust plate. A similar beneficial effect is achieved by providing at least one protrusion at the first side of the thrust plate and at least one the recess at the backside of the orbiting scroll plate.

The person skilled in the art will appreciate that the at least one recess and the at least one protrusion are provided at overlapping locations, but while the at least one protrusion is located at the first side of the thrust plate, the at least one recess may be located at the first side of the thrust plate or the backside of the orbiting scroll plate. Further, the person skilled in the art will appreciate that recesses may also be provided at the second side of the thrust plate and the backside of the orbiting scroll plate. For example, in case that multiple protrusions and recess are provided, it may be possible to provide a recess at the second side of the thrust plate and the backside of the orbiting scroll plate for each protrusion or that for each protrusion, a recess is either provided at the second side of the thrust plate or the backside of the orbiting scroll plate.

The thrust plate of the system may have any of the features described above with respect to the embodiments of the thrust plate described earlier.

The above-mentioned need is also fulfilled by a scroll compressor according to the current invention. The scroll compressor either comprises a thrust plate according to the current invention as mentioned above and an orbiting scroll plate, which may have a base plate with a frontside and a backside, or a system according to the current invention comprising a thrust plate and an orbiting scroll plate. In other words, the scroll compressor comprises either a thrust plate having at least one recess and at least one protrusion and an orbiting scroll plate, which may be a state of the art orbiting scroll plate, or the scroll compressor comprises a thrust plate with at least one protrusion and an orbiting scroll plate with at least one recess.

The backside of the orbiting scroll plate of either scroll compressor configuration may comprise an aperture and a plurality of notches. The aperture and the plurality of notches may be configured to couple the orbiting scroll plate to a motor and provide for orbiting motion of the orbiting scroll plate.

Further, the scroll compressor may comprise a motor, a frame, a crankshaft, and an Oldham coupling. The motor may be connected to the crankshaft and configured to drive the crankshaft, e.g. by rotating the crankshaft. The crankshaft may comprise a first end, which may be configured to be received in the aperture at the backside of the orbiting scroll plate. This arrangement allows to transfer motion from the crankshaft to the orbiting scroll plate. The Oldham coupling may have a plurality of pins, which may be received from the plurality of notches of the backside of the orbiting scroll plate. Further, the frame may support the Oldham coupling and the orbiting scroll plate. In this arrangement, when the motor is energized, the crankshaft rotates and transfers motion to the orbiting scroll plate. Since the pins of the Oldham coupling engage the plurality of notches of the orbiting scroll plate, a rotation of the orbiting scroll plate is prevented, thereby ensuring that the orbiting scroll plate moves in an orbit relatively to the stationary scroll plate.

The thrust plate in either scroll compressor configuration may be disposed between the orbiting scroll plate and the frame. The thrust plate may comprise a plurality of holes, which extend from a surface of the first side to a surface of the second and through which the plurality of pins of the Oldham coupling may extend. Further, the thrust plate may comprise an aperture, which extends from the surface of the first side to the surface of the second side and which is configured to receive a portion of the crankshaft and/or a portion of the orbiting scroll plate.

The thrust plate comprised in the scroll compressor may have any of the features described above with respect to the embodiments of the thrust plate according to the invention.

In the assembled scroll compressor, the Oldham coupling may be placed behind the thrust plate or around the at least one protrusion of the first side of the thrust plate. This means that the Oldham coupling may, for example, be placed in clearances, which are formed around the at least one protrusion of the thrust plate.

DRAWINGS

In the drawings, like reference characters generally refer to the same parts throughout the different drawings. The drawings are not necessarily to scale, emphasis instead generally being placed upon illustrating the principles of the invention.

In the following description, various embodiments of the invention are described with reference to the following drawings, in which.

Figure 3A:
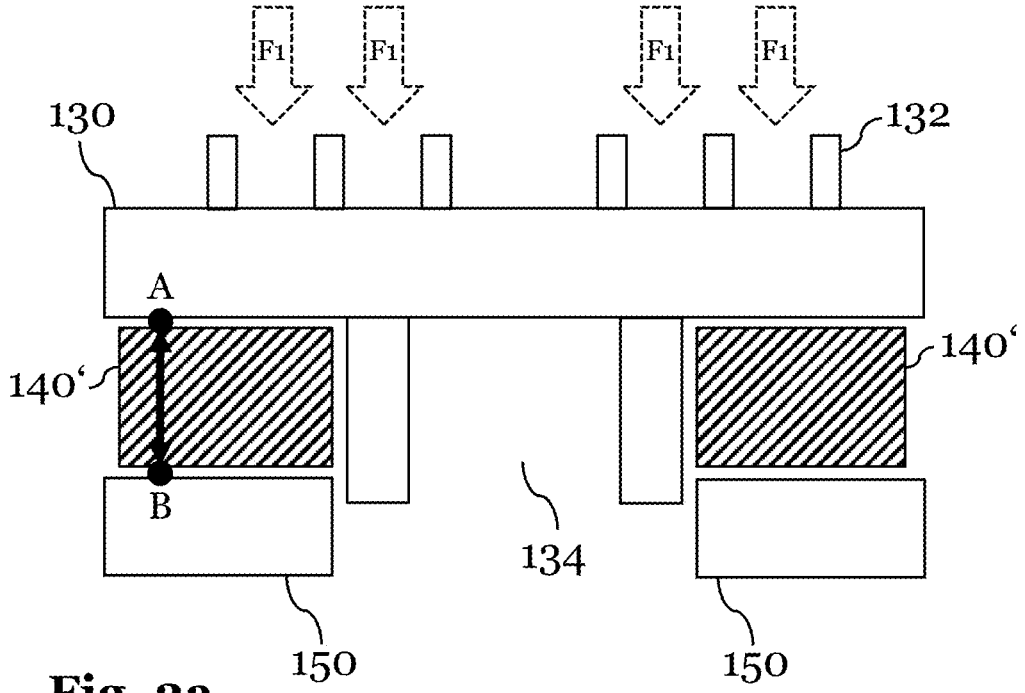
Figure 3B:
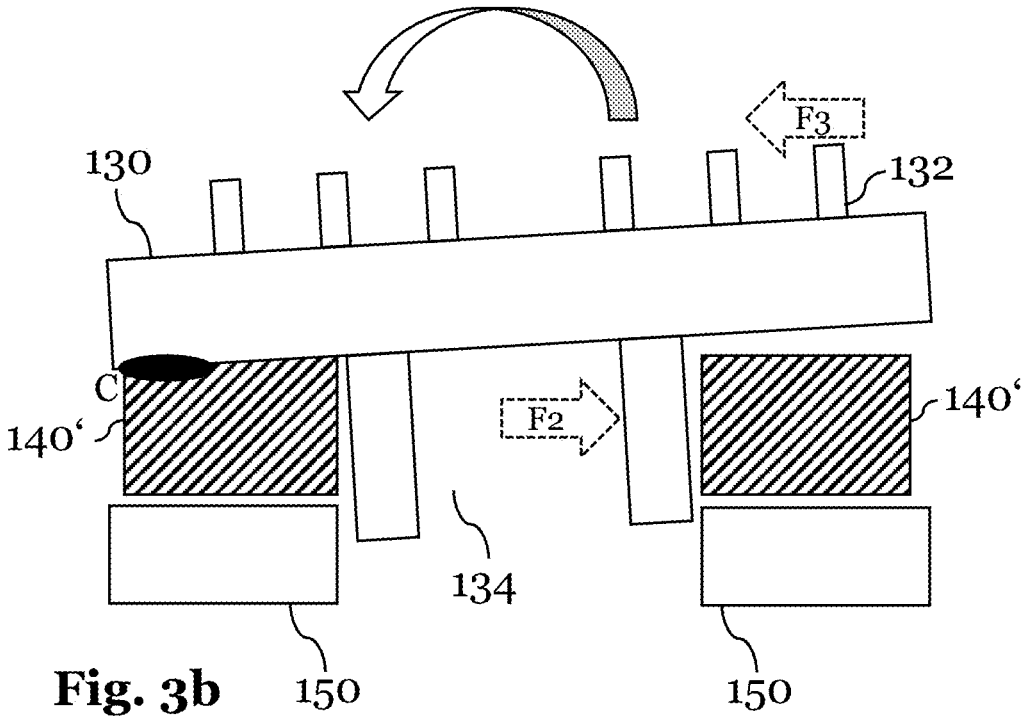

FIGS. 3*a*, 3*b* show cross-sectional views of a thrust plate disposed between a frame and an orbiting scroll plate, wherein the forces caused by high fluid pressure during compression, which act on the orbiting scroll plate, are illustrated. Thereby, FIG. 3*a* illustrates the forces pushing the orbiting scroll plate towards the thrust plate and FIG. 3*b* illustrates wobbling or tilting caused by motion of the orbiting scroll plate.

Figure 4A:
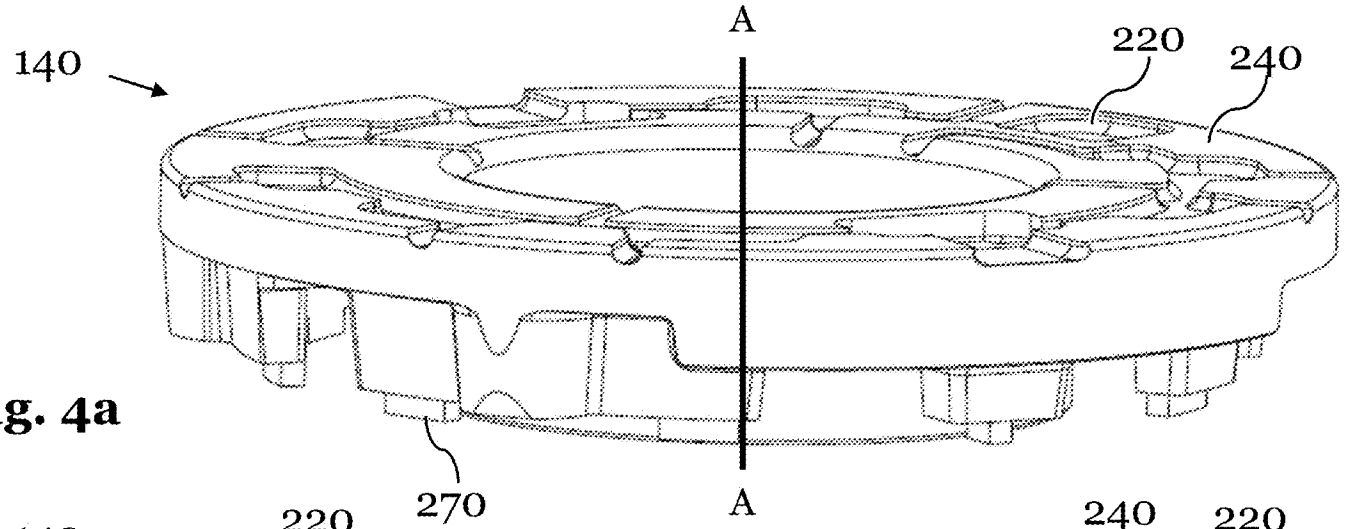
Figure 4B:
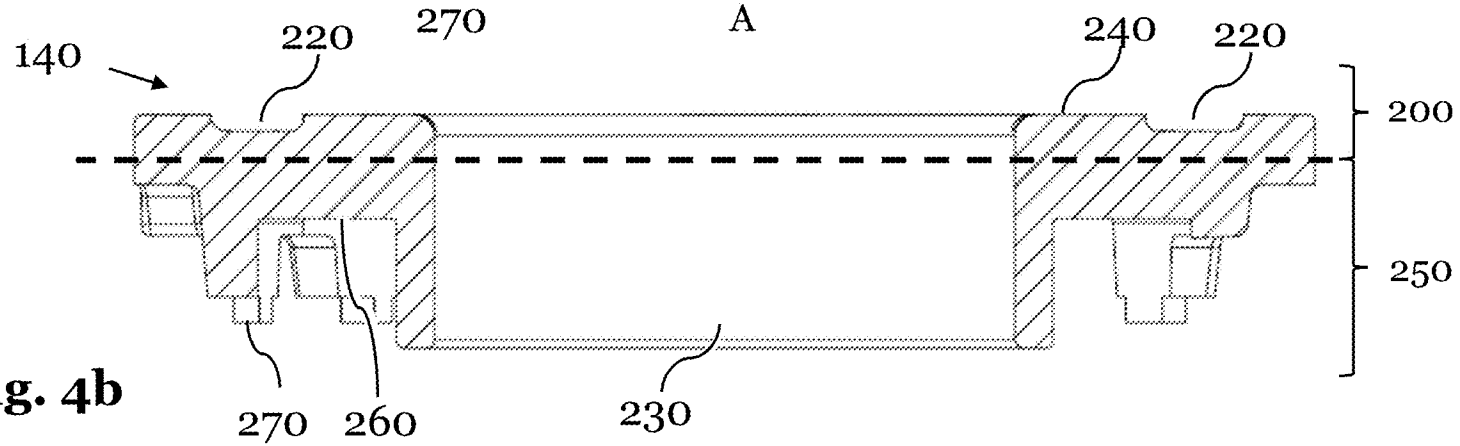

FIGS. 4*a*, 4*b* show (a) a perspective view of an exemplary embodiment of the thrust plate according to the current invention and (b) a cross-sectional view along line A-A of FIG. 4*a*.

Figure 5A:
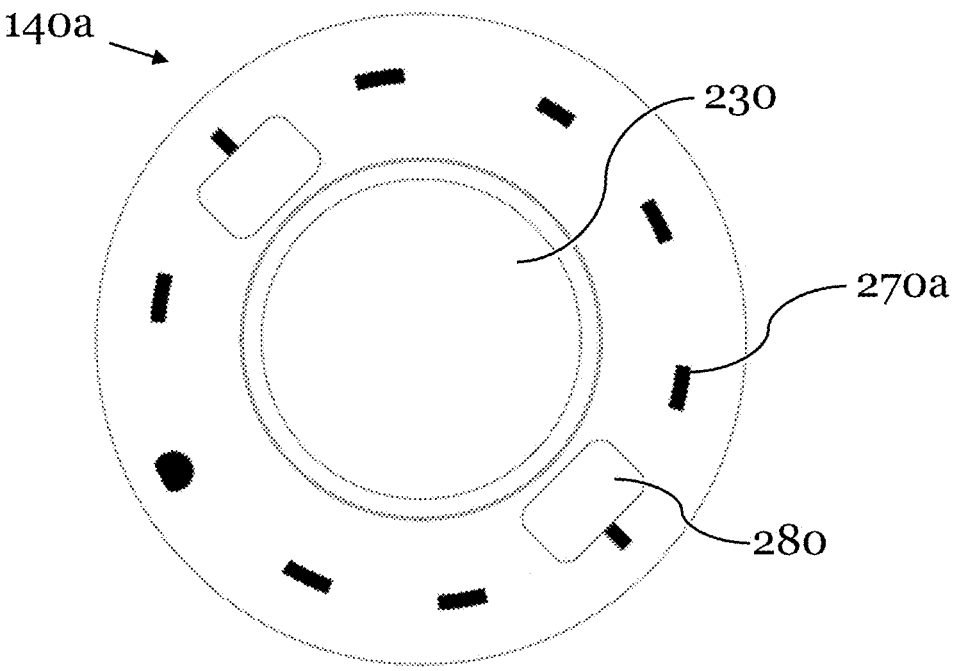
Figure 5B:
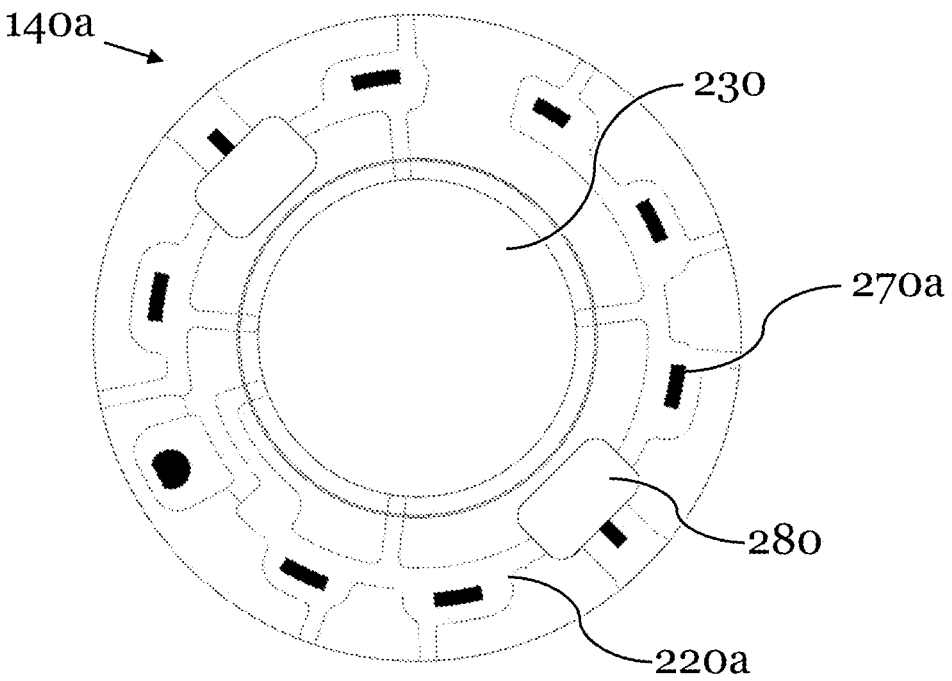

FIGS. 5*a*, 5*b* show (a) a bottom view of exemplary protrusions at a first side of a thrust plate according to one embodiment of the current invention and (b) an overlap of the protrusions at the first side and the recesses at the second side. In this embodiment, the protrusions and the recesses form an exemplary pattern.

Figure 6A:
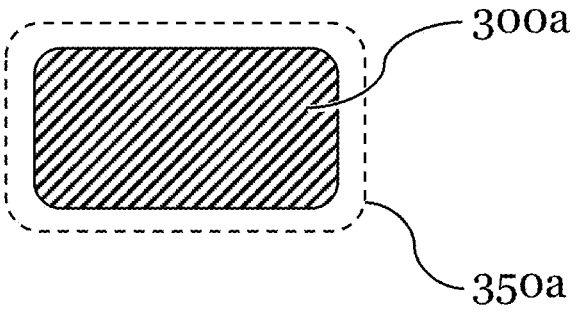
Figure 6B:
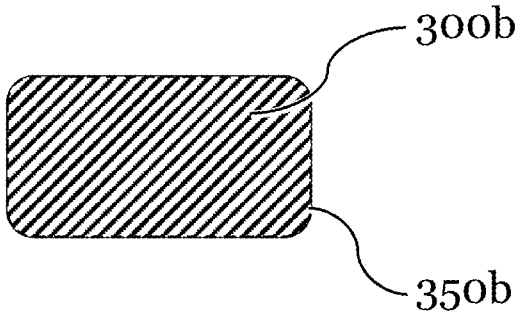
Figure 6C:
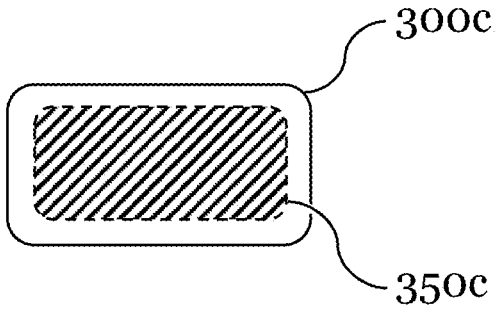

FIGS. 6*a-c* show schematics of the overlap of a protrusion and a recess in a direction perpendicular to the plane defined by the disk-shaped body of the thrust plate, wherein (a) illustrates a protrusion, which overlaps entirely with a recess, while the recess itself is larger, (b) illustrates a protrusion and a recess of the same size and (c) illustrates a recess overlapping entirely with a protrusion, while the protrusion itself is larger.

Figure 7A:
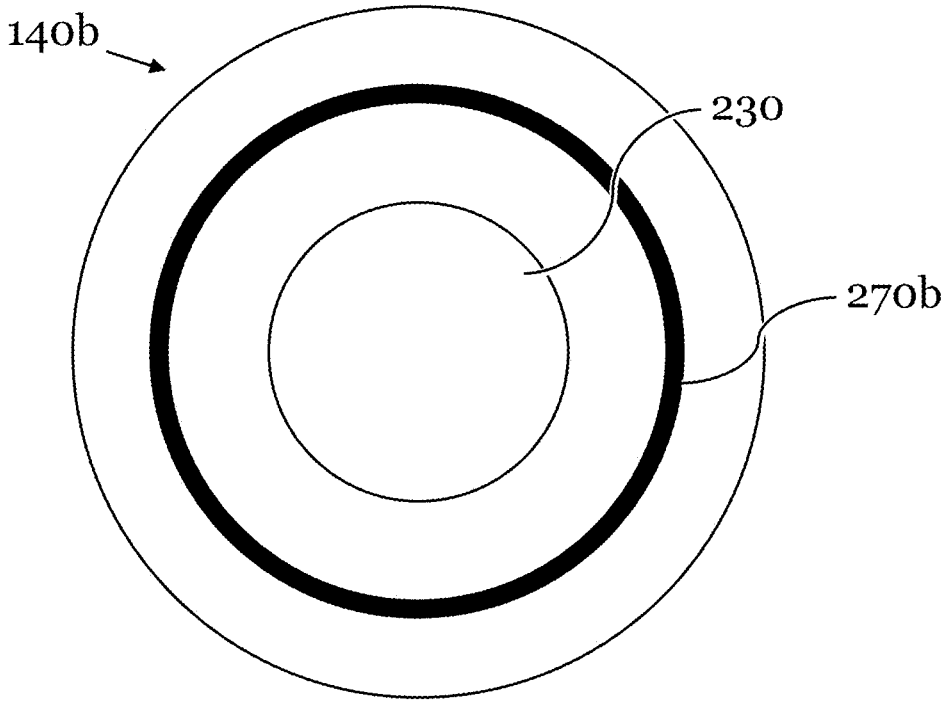
Figure 7B:
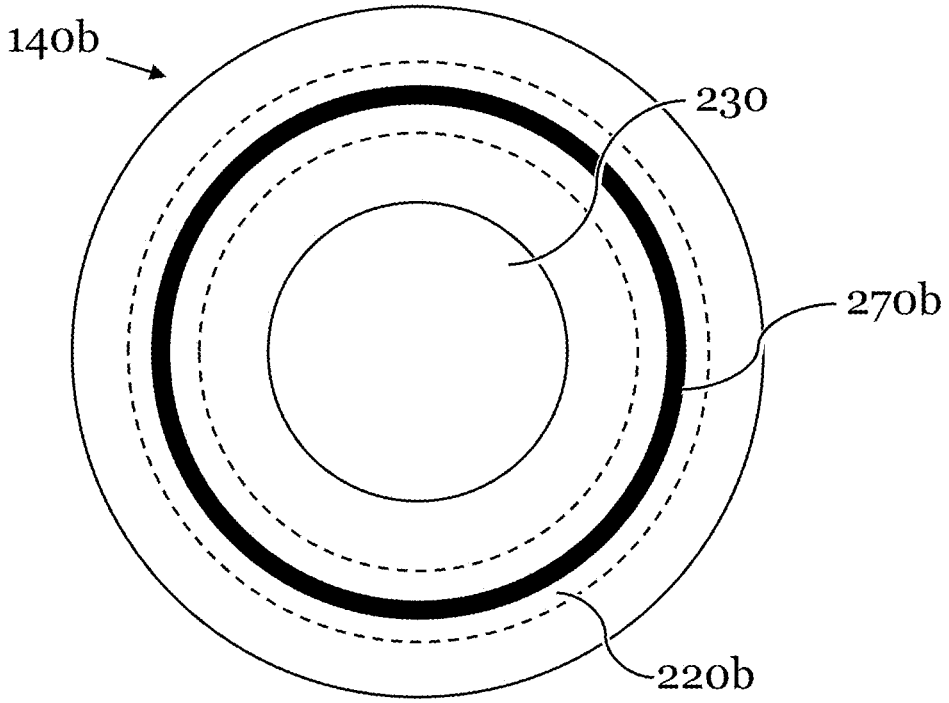

FIGS. 7*a*, 7*b* show (a) a bottom view of an exemplary annular protrusion at a first side of a thrust plate according to a further embodiment of the current invention and (b) an overlap of the protrusions at the first side and the recesses at the second side. In this embodiment, the protrusions and the recesses form concentric rings.

Figure 8A:
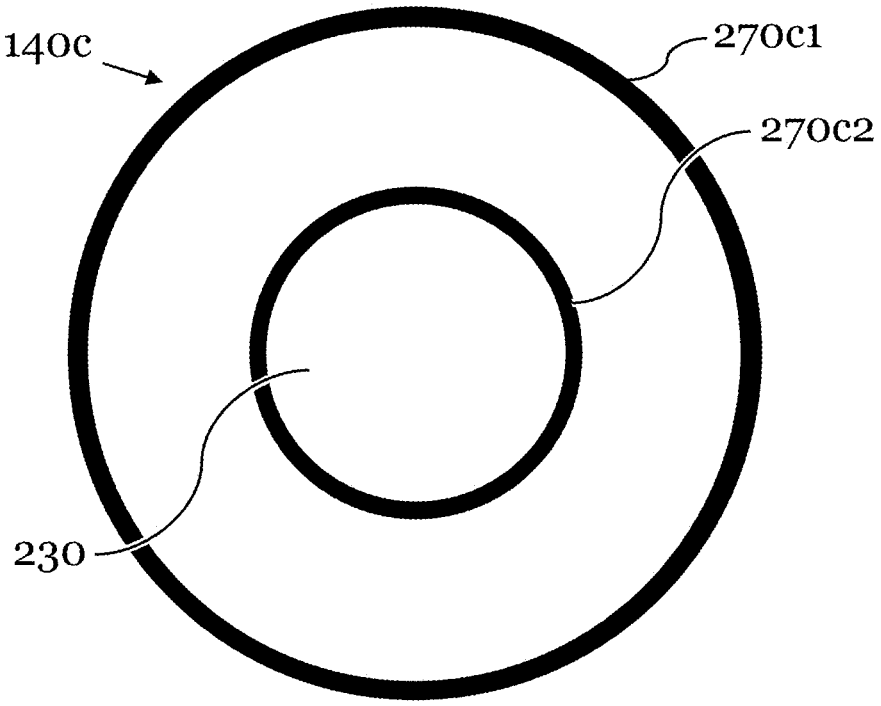
Figure 8B:
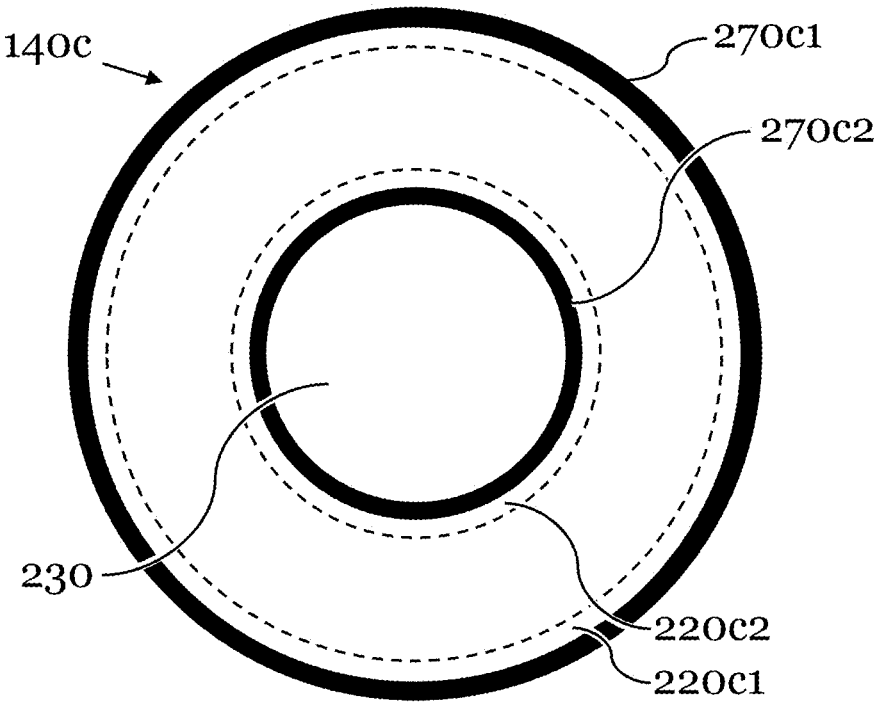

FIGS. 8*a*, 8*b* show (a) a bottom view of exemplary annular protrusions at a first side of a thrust plate according to a further embodiment of the current invention and (b) an overlap of the protrusions at the first side and the recesses at the second side. In this embodiment, the protrusions and the recesses form concentric rings at the edges of the thrust plate.

Figure 9A:
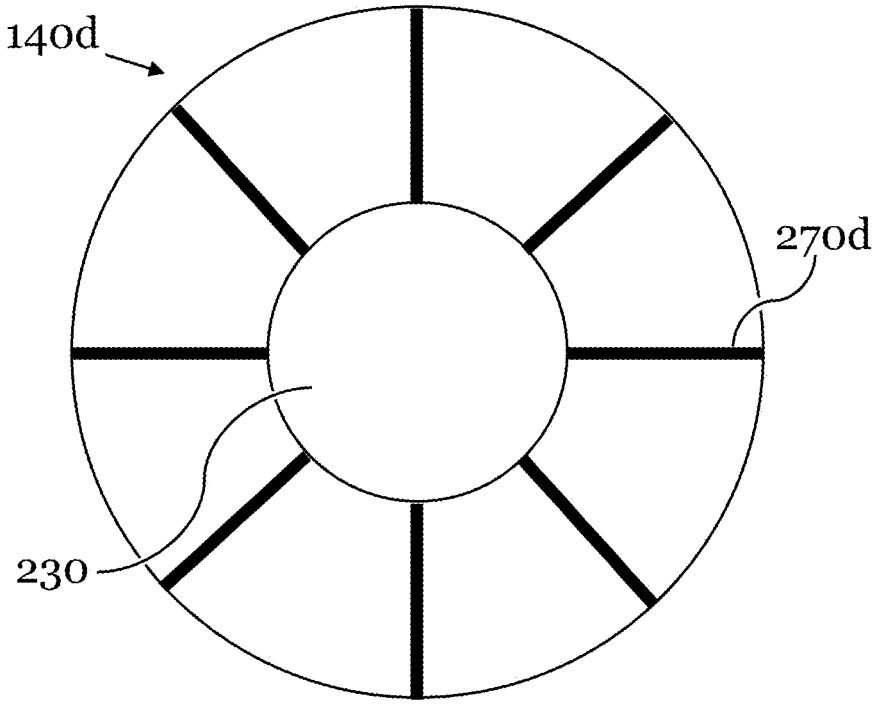
Figure 9B:
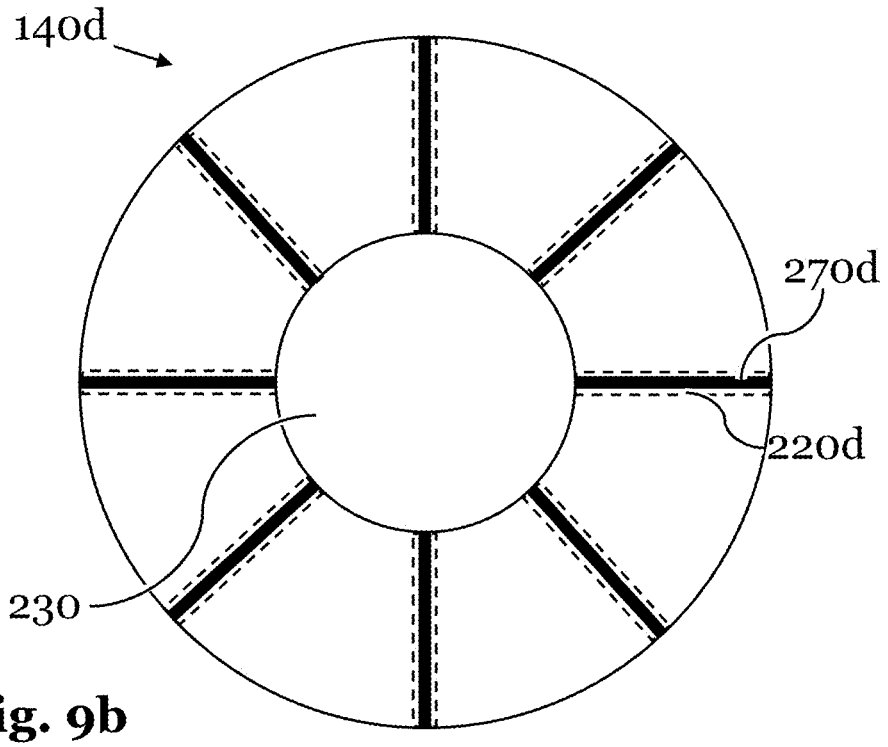

FIGS. 9*a*, 9*b* show (a) a bottom view of exemplary protrusions at a first side of a thrust plate according to a further embodiment of the current invention and (b) an overlap of the protrusions at the first side and the recesses at the second side. In this embodiment, the protrusions and the recesses extend radially from a center of the surface of the respective side of the thrust plate.

Figure 10:
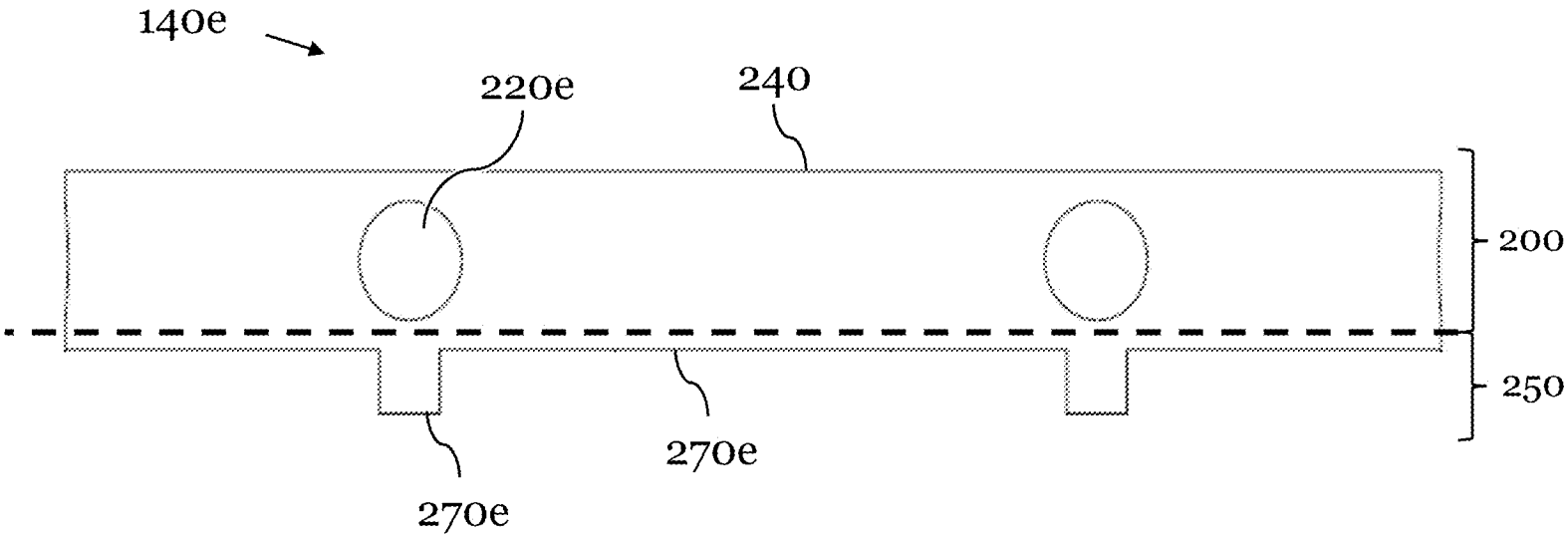

FIG. 10 shows a cross-sectional view of a thrust plate according to a further embodiment of the current invention, wherein the recess of the second side is located beneath the surface of the second side.

FIGS. 11*a-d* show perspective views of (a) an orbiting scroll plate and (b), (c) thrust plates according to a further embodiment of the current invention as well as (d) an overlap of the protrusions and the recesses.

DETAILED DESCRIPTION

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

Figure 1:
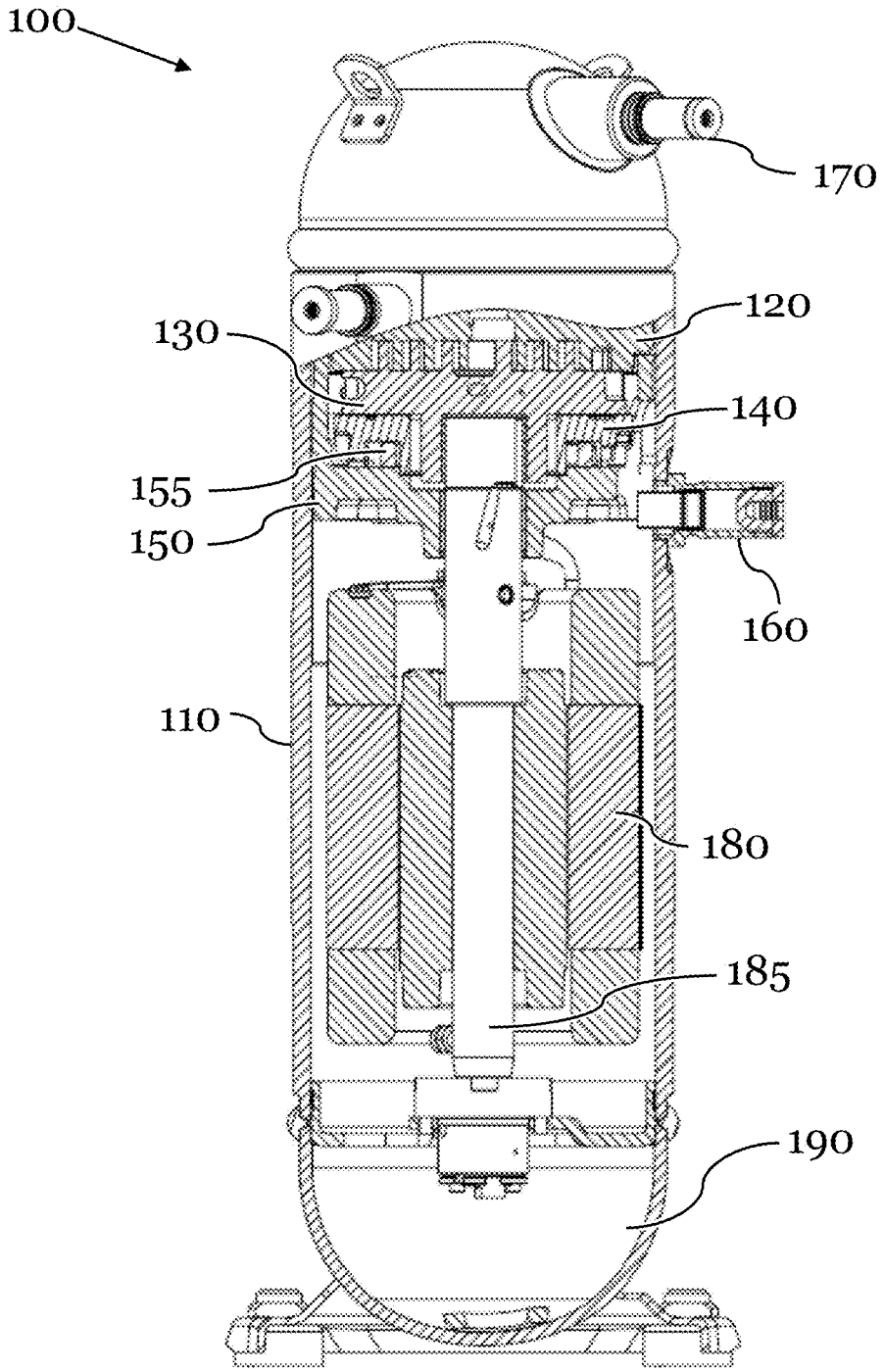
FIG. 1 shows a cross-sectional view of an exemplary scroll compressor in which the current invention may be exercised.

FIG. 1 shows a cross-sectional view of an exemplary scroll compressor in which the current invention may be exercised.

As depicted in FIG. 1, the scroll compressor 100 comprises a case 110, a suction port 160 for receiving fluid (e.g. a refrigerant) from a cycle (e.g. a refrigeration cycle), a scroll set 120, 130 for compressing the fluid and a discharge port 170 for discharging the compressed fluid and providing it back to the cycle. The scroll set 120, 130 comprises a stationary scroll plate 120, and an orbiting scroll plate 130. The stationary scroll plate 120 has an opening in its center, which is connected to a high pressure side of the scroll compressor. The opening of the stationary scroll plate may be connected to the high pressure side via a valve, for example a check valve.

The orbiting scroll plate 130 may be driven by a motor 180. The motor 180 drives a crankshaft 185, which causes a rotational motion of the crankshaft 185. The crankshaft 185 transfers its rotational motion to an orbiting motion of the orbiting scroll plate 130. This is achieved by providing the crankshaft 185 with a first end, which engages a slider block, which is placed in an aperture at the backside of the orbiting scroll plate 130. The slider block slides within the aperture, which avoids a rotation of the orbiting scroll plate 130. However, if the first end of the crankshaft 185 is offset to the rotation axis of the crankshaft 185, the orbiting scroll plate 130 will still be moved, but only in an orbiting path relatively to the stationary scroll plate 120.

In order to further avoid rotational motion of the orbiting scroll plate 130, an Oldham coupling 155 is provided, which engages the orbiting scroll plate 130. The Oldham coupling 155 has pins, which engage notches in the orbiting scroll plate 130.

The scroll compressor comprises a thrust plate 140, which is disposed between the backside of the orbiting scroll plate 130 and a frame 150, which supports the scroll set 120, 130. The thrust plate 140 comprises one or more protrusions and one or more recesses on corresponding locations of its opposing sides as will be described in more detail with respect to the following drawings. The Oldham coupling 155 is disposed behind the thrust plate 140 in clearances around the one or more protrusions of the thrust plate 140.

Additionally, the scroll compressor 100 depicted in FIG. 1 comprises a lubricant supply 190, which is connected to the crankshaft 185. Thereby, it is ensured that lubricant can be provided to the moving components of the scroll compressor 100, which reduces wear.

Figure 2:
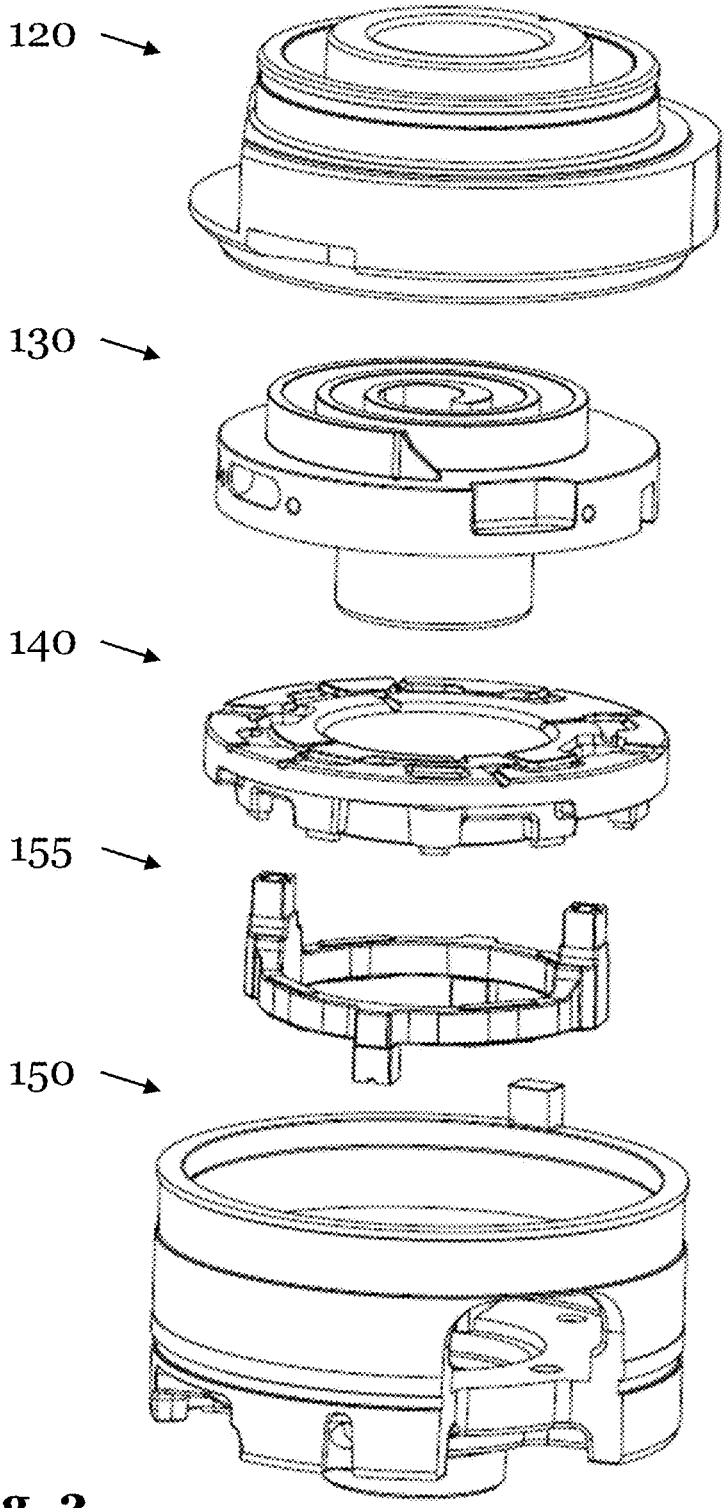
FIG. 2 shows an exploded view of the scroll plates, the thrust plate, the Oldham coupling, and an exemplary portion of the frame of the scroll compressor of FIG. 1.

FIG. 2 shows an exploded view of the scroll plates 120, 130, the thrust plate 140, the Oldham coupling 155, and an exemplary portion of the frame 150 of the scroll compressor wo depicted in FIG. 1. From top to bottom of FIG. 2 the stationary scroll plate 120, the orbiting scroll plate 130, the thrust plate 140, the Oldham coupling 155 and a portion of the supporting frame 150 are shown. Stacking said components together in this order creates the assembly depicted in abovementioned FIG. 1.

FIGS. 3*a*, 3*b* show cross-sectional views of a thrust plate 140' disposed between a frame 150 and an orbiting scroll plate 130, wherein the forces caused by high fluid pressure during compression, which act on the orbiting scroll plate 130 are illustrated. The thrust plate 140' depicted in FIGS. 3*a*, 3*b* is a disk without protrusions or recesses. Such a thrust plate 140' provides for a thrust surface, which can distribute the load experienced by the motion of the orbiting scroll plate. However, the disk-shaped thrust plate 140' is sturdy and provides a hard contact between the orbiting scroll plate 130 and the supporting frame 150.

As is depicted in FIG. 3*a*, the fluid compressed at a high pressure creates a force F1, which pushes the orbiting scroll 130 away from the stationary scroll plate, i.e. downwards with respect to the orientation shown in FIG. 3*a* (see arrows in FIG. 3*a*). This presses the thrust plate 140' against the supporting frame 150. Because of the solid structure of the thrust plate 140', the thrust plate 140' is sturdy and provides for hard contact, as is depicted by line A-B in FIG. 3*a*. Such a hard contact results in high contact stress and affects the lifetime of the compressor negatively.

Furthermore, upon motion of the orbiting scroll plate, tilting forces act on the orbiting scroll plate 130, which result in squeezing of the thrust plate 140'. However, because of the hard contact, the thrust plate 140' cannot be deformed, which increases the wear and contact stress. This behavior is depicted in FIG. 3*b*. The crankshaft engages the aperture 134 at the backside of the orbiting scroll plate 130. When the crankshaft rotates, a force is applied to the boundary of the aperture 134, thereby pushing the orbiting scroll plate to the side, as is illustrated by force F2 in FIG. 3*b*. The orbiting motion of the orbiting scroll plate 130 caused by force F2 compresses the fluid within the compression chamber formed between the spiral wrap 132 of the orbiting scroll plate 130. Because the compression results in increased pressure, the pressure causes force $F_3$, which is directed against the orbiting motion. Since force F2 acts on the backside of the orbiting scroll plate 130 and force F3 acts on the frontside of the orbiting scroll plate 130, there is an offset between these forces, which results in wobbling or tilting of the orbiting scroll plate as is illustrated in FIG. 3*b*. The person skilled in the art will appreciate that the tilt illustrated in FIG. 3*b* is shown exaggerated for illustrative purposes. As a result of wobbling or tilting, additional stress is applied onto the thrust plate 140' locally. In the illustrative example depicted in FIG. 3*b*, forces F2 and F3 cause a tilt of the orbiting scroll plate 130 towards the left-hand side of the thrust plate 140', thereby causing local squeeze at point C. Using a thrust plate with recess and protrusion according to the current invention reduces the stiffness of the thrust plate and thereby improves the adaptability of the thrust plate to a wobbling or tilting orbiting scroll plate, thereby reducing wear and improving the durability of the scroll compressor.

FIGS. 4*a*, 4*b* show (a) a perspective view of an exemplary embodiment of the thrust plate 140 according to the current invention and (b) a cross-sectional view along line A-A of FIG. 4*a*.

The thrust plate 140 comprises a disk-shaped body, which defines a plane and has a first side 250 and a second side 200. The plane may correspond to the dashed line illustrated in FIG. 4*b*, which separates the first and second sides. Protrusions 270 are formed at the first side 250 of the thrust plate 140, which are configured to contact the supporting frame, and recesses 220 are formed at the second side 200 of the thrust plate 140, wherein the second side 250 is configured to contact the backside of the orbiting scroll plate. The at least one protrusion 270 and the at least one recess 220 overlap at least partially in a direction perpendicular to the plane. Because of the overlap of the recesses 220 and the protrusions 270, any location of hard contact (as shown above with respect to FIG. 3*a*) is avoided. This allows for reducing the sturdiness and stiffness of the thrust plate 140 and enables a slight deformation of the thrust plate 140, which reduces the wear and contact stress.

FIG. 4*b* illustrates the terms first side 250 and second side 200. The dashed line is shown to identify the first side 250 below the dashed line and the second side 200 above the dashed line. Accordingly, said terms are not limited to a surface, but rather refer to the respective surface and an adjacent portion of the disk-shaped body below the surface. In the example depicted in FIG. 4*b*, the first side 250 may also be referred to as bottom side and the illustrated protrusion 270 extends from the surface 26*o* of the first side 250 downwardly. The second side 200 may also be referred to as top side and the illustrated recess 220 is located at the surface 240 of the second side 200. As can be seen in FIG. 4*b*, the contact surface for contact between the thrust plate 140 and the backside of the orbiting scroll plate does not overlap with the contact between the protrusions of the thrust plate and the supporting frame.

As the disk-shaped body of the thrust plate defines a plane, a cross-section identified by the dashed line may be an example of a location and course of such a plane. The plane may be parallel to the surface 240 of the second side of the thrust plate as is depicted in FIG. 4*b*. However, the surface 240 of the second side 200 may also represent the plane defined by the disk-shaped body. Similarly, the plane may also be defined by the surface of the 260 of the first side 250. Further, any plane parallel to any of the aforementioned surfaces or the cross-section identified by the dashed line of FIG. 4*b* may represent the plane. The person skilled in the art will appreciate that the plane is used to identify geometrical properties of the thrust plate and various locations of the plane are possible.

FIGS. 5*a*, 5*b* show (a) a bottom view of exemplary protrusions at a first side of a thrust plate according to one embodiment of the current invention and (b) an overlap of the protrusions at the first side and the recesses at the second side. In this embodiment, the protrusions and the recesses form an exemplary pattern. The thrust plate 140*a* according to the embodiment example depicted in FIG. 5*a* comprises a plurality of protrusions 270*a*. The plurality of protrusions 270*a* are illustrated in black and extend from the surface of the first side of the thrust plate 140*a*. As can be seen, the protrusions 270*a* are distributed in an annular fashion. Further, as can also be seen, the protrusions 270*a* do not necessarily have the same shape. Distributing the protrusions 270*a* in an evenly manner as is done in the embodiment example of FIG. 3*a* provides for a symmetric support of the orbiting scroll plate and improves the durability of the scroll compressor.

In FIG. 5*b* the overlap of the protrusions 270*a* with recesses 220*a* at the second side of the thrust plate 140*a* is illustrated. The recesses 220*a* are illustrated as dashed lines. As can be seen in FIG. 5*b*, each protrusion 270*a* is located in an area that overlaps with a location of a recess 220*a*. Further, the area covered by the recesses 220*a* is larger than the area covered by the protrusions. Such a configuration provides improved soft contact as will be described in more detail with respect to FIGS. 6*a* to 6*c*. The recesses 220*a* formed at the second side of the thrust plate 140*a* are connected in order to form a pattern on the surface of the second side of the thrust plate 140*a*.

FIGS. 5*a*, 5*b* also illustrate further features of the thrust plate. The thrust plate 140*a* comprises two holes 280, which can receive pins of an Oldham coupling, so that the pins of the Oldham coupling can reach through the body of the thrust plate 140*a* and engage the orbiting scroll plate. Further, the thrust plate 140*a* comprises an aperture 230 in the center of its body. The aperture 230 is configured to receive a portion of a crankshaft, so that the crankshaft can reach through the body of the thrust plate 140*a* and can engage an orbiting scroll plate.

FIGS. 6*a*, 6*b*, 6*c* show schematics of the overlap of a protrusion and a recess in a direction perpendicular to the plane defined by the disk-shaped body of the thrust plate, wherein (a) illustrates a protrusion 300*a*, which overlaps entirely with a recess 350*a*, while the recess 350*a* itself is larger, (b) illustrates a protrusion 300*b* and a recess 350*b* of the same size and (c) illustrates a recess 350*c* overlapping entirely with a protrusion 300*c*, while the protrusion 300*c* itself is larger.

In FIGS. 6*a* to 6*c*, the solid lines illustrate a protrusion, whereas the dashed lines illustrate a recess. Hatched areas indicate overlap between the protrusion and the recess in a direction perpendicular to the plane, wherein the plane is the image plane of FIGS. 6*a* to 6*c*. In FIG. 6*a*, the protrusion 300*a* overlaps entirely with the recess 350*a*, but a portion of the recess 350*a* does not overlap with any portion of the protrusion 300*a*. In other words, the recess 350*a* is greater than the protrusion 300*a*. The non-overlapping portion of the recess 350*a* may extend outwardly in any in-plane direction for about 1 to 2 mm. Said portion may also be referred to as a buffer or transition region. In FIG. 6*b*, the protrusion 300*b* overlaps entirely with the recess 350*b* and the recess 350*b* overlaps entirely with the protrusion 300*b*. In other words, the protrusion 300*b* and the recess 350*b* have the same size with respect to the plane and overlap with each other entirely. In FIG. 6*c*, the recess 350*c* overlaps entirely with the protrusion 300*c*, but a portion of the protrusion 300*c* does not overlap with any portion of the recess 350*c*. In other words, the protrusion 300*c* is greater than the recess 350*c*. In some cases, the configuration illustrated in FIG. 6*c* may be beneficial, even though there is hard contact in the small area in which the protrusion 300*c* does not overlap with any portion of the recess 350*c*. The hard contact leads to wear-off in these areas, which will re-distribute the contact stress. Preferably, the non-overlapping area has an extend of 2 mm or less.

FIGS. 7*a*, 7*b* show (a) a bottom view of an exemplary annular protrusion 270*b* at a first side of a thrust plate 140*b* according to a further embodiment of the current invention and (b) an overlap of the protrusion 270*b* at the first side and the recess 220*b* at the second side. In this embodiment, the protrusion and the recess form concentric rings. Similarly to FIGS. 5*a*, 5*b*, the protrusion 270*b* is illustrated in black and the recess is illustrated in dashed lines.

FIGS. 8*a*, 8*b* show (a) a bottom view of exemplary annular protrusions 270*c*1, 270*c*2 at a first side of a thrust plate 140*c* according to a further embodiment of the current invention and (b) an overlap of the protrusions 270*c*1, 270*c*2 at the first side and the recesses 220*c*1, 220*c*2 at the second side. In this embodiment, the protrusions 270*c*1, 270*c*2 and the recesses 220*c*1, 220*c*2 form concentric rings at the edges of the thrust plate. Similarly to FIGS. 5*a*, 5*b*, the protrusions 270*c*1, 270*c*2 are illustrated in black and the recesses 220*c*1, 220*c*2 are illustrated in dashed lines. Whereas the protrusion and recess in the embodiment example in FIGS. 7*a*, 7*b* are located in the center of the disk formed by the disk-shape body, the protrusions and recesses of the embodiment example of FIG. 8*a*, 8*b* are located at the outer edge and the inner edge, i.e. near the location of the aperture 230 in the center.

FIG. 9*a*, 9*b* show (a) a bottom view of exemplary protrusions 270*d* at a first side of a thrust plate 140*d* according to further embodiment of the current invention and (b) an overlap of the protrusions 270*d* at the first side and the recesses 220*d* at the second side. In this embodiment, the protrusions 270*d* and the recesses 220*d* extend radially from a center of the surface of the respective side of the thrust plate. In this embodiment example, the protrusions 270*d* are formed as radial bars, while the recesses 220*d* are formed as radial grooves. Similarly to FIGS. 5*a*, 5*b*, the protrusions 270*d* are illustrated in black and the recesses 220*d* are illustrated in dashed lines.

FIG. 10 shows a cross-sectional view of a thrust plate 140*e* according to a further embodiment of the current invention, wherein the recess 220*e* at the second side 200 is located beneath the surface 240 of the second side 200. This embodiment example achieves the soft contact without reducing the surface 240, which can contact the orbiting scroll plate. Therefore, such an embodiment example may provide a maximized contact surface between the thrust plate and the orbiting scroll plate and thereby a maximum of contact stress reduction.

FIGS. 11*a-d* show perspective views of (a) an orbiting scroll plate and (b), (c) thrust plates according to a further embodiment of the current invention as well as (d) an overlap of the protrusions and the recesses.

The embodiment example depicted in FIGS. 11*a-d* is an example of the system of an orbiting scroll plate and a thrust plate according to the current invention. The orbiting scroll plate 400 depicted in FIG. 11*a* comprises a base plate 450 having a frontside and a backside. At the frontside, the baseplate 450 comprises a spiral wrap 410 for being interleaved with a corresponding spiral wrap of a stationary scroll plate. At the backside, the base plate 450 comprises an aperture 420 for receiving a portion of a crankshaft configured to drive the orbiting motion of the orbiting scroll plate 400. Further, the backside of the base plate 450 comprises a plurality of recesses 430.

Figure 11A:
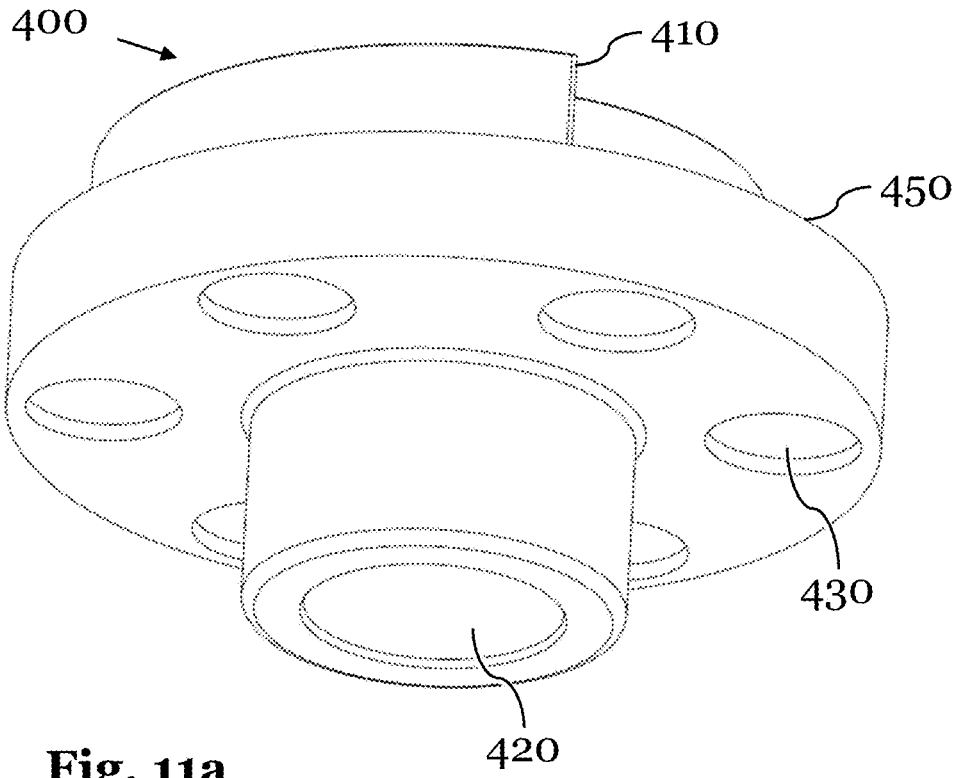
Figure 11B:
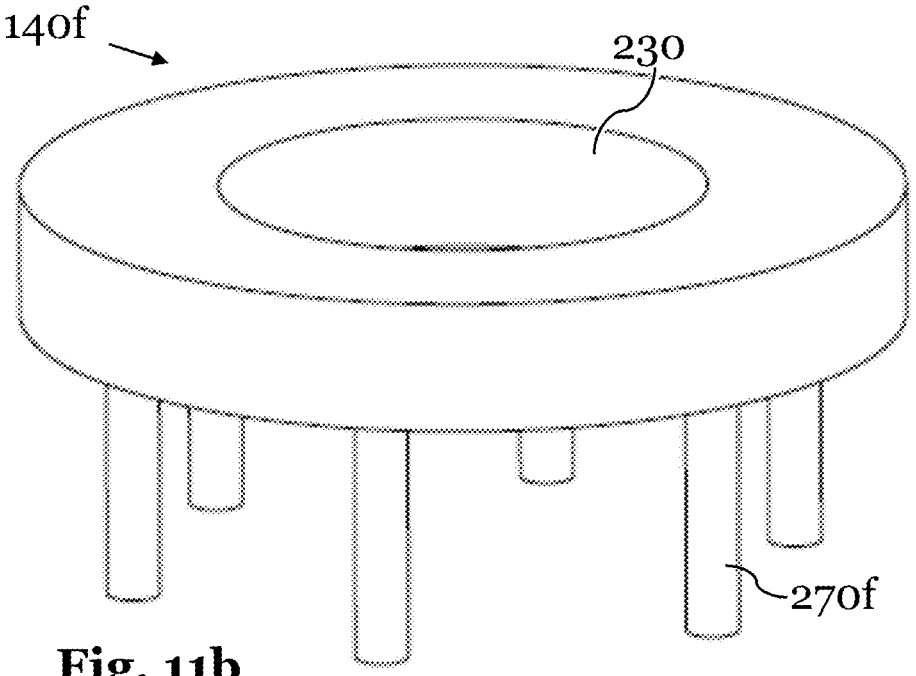

As is illustrated in FIG. 11*b*, the thrust plate 140*f* comprises a base plate with a first side and a second side. The first side comprises a plurality of protrusions 270*f*. When the system of the orbiting scroll plate 400 and the thrust plate 140*f* is assembled, the plurality of protrusions 270*f* and the plurality of recesses 430 of the orbiting scroll plate 400 overlap in a direction perpendicular to the base plate of the thrust plate 140*f*. As such, the system of the orbiting scroll plate 400 and the thrust plate 140*f* provides the benefit of avoiding hard contact, because the thrust plate is supported at the locations of the protrusions 270*f*, while there is contact between the orbiting scroll plate 400 and the thrust plate 140*f* at other locations because of the recesses 430.

Figure 11C:
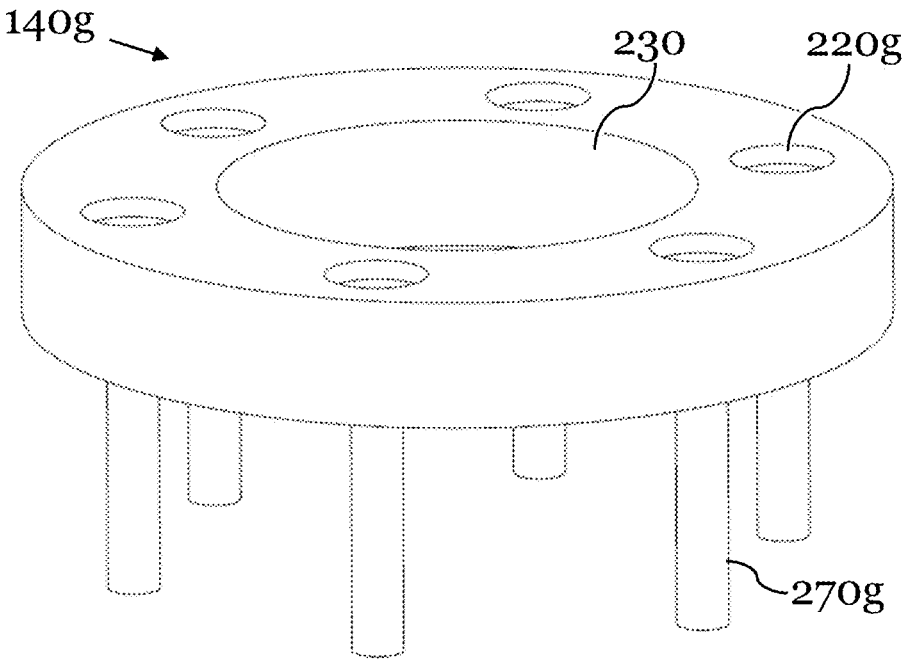

Alternatively to the thrust plate 140*f* depicted in FIG. 11*b*, the thrust plate 140*g* depicted in FIG. 11*c* can also be used. Compared to the thrust plate 140*f*, the thrust plate 140*g* comprises a plurality of recesses 220*g* at locations overlapping with the plurality of protrusions 270*g*. In this case, recesses are provided to the backside of the orbiting scroll plate 400 as well as the second side of the thrust plate 140*g*, which may even further improve the hard contact avoidance.

Figure 11D:
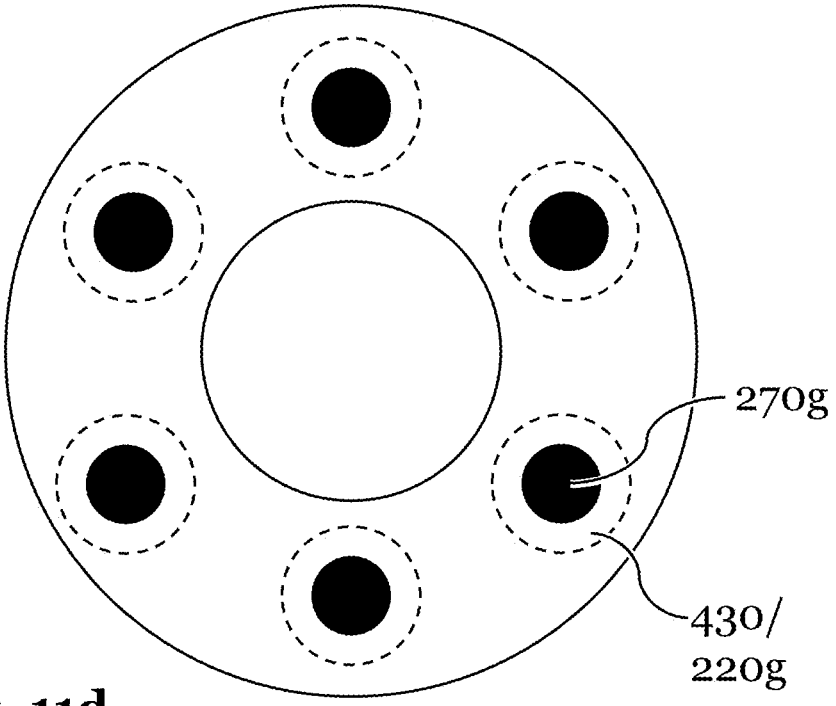

In order to further illustrate the overlap of the protrusions and recesses, FIG. 11*d* depicts an overlay of the orbiting scroll plate 400 of FIG. 11*a* and the thrust plate 140*f* or 140*g* of FIGS. 11*b*, 11*c*. The overlay is illustrated similarly to the overlays depicted in FIGS. 5*b*, 7*b*, 8*b*, 9*b*. For illustrative purposes, the recesses illustrated in dashed lines may either be the recesses 430 of the orbiting scroll plate 400 or the recesses 270*g* of the thrust plate 140*g*. As is depicted in FIG. 11*d*, the recesses preferably cover a larger section than the protrusions in order to allow for sufficient overlap even if the orbiting scroll plate 400 is orbiting relatively to the thrust plate 140*f* or thrust plate 140*g*, respectively.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the scope of the appended claims.

The invention claimed is:

1. A thrust plate for use in a scroll compressor, the thrust plate comprising:

a disk-shaped body defining a plane and having a first side and a second side, wherein the second side opposes the first side, wherein the disk-shaped body comprises a plurality of holes, which extend from a surface of the first side to a surface of the second side and which are configured to receive pins of an Oldham coupling;

at least one protrusion extending from the first side; and at least one recess located at the second side;

wherein the at least one protrusion and the at least one recess overlap at least partially in a direction perpendicular to the plane, wherein the at least partial overlap is defined by the at least one protrusion overlapping entirely with the at least one recess.

2. The thrust plate according to claim 1, wherein the disk-shaped body comprises an aperture, which extends from the surface of the first side to the surface of the second side and which is configured to receive a portion of a crankshaft and/or a portion of an orbiting scroll plate.

3. The thrust plate according to claim 1, wherein the at least one recess is located at the surface of the second side.

4. The thrust plate according to claim 1, wherein the at least one recess is located beneath the surface of the second side.

5. The thrust plate according to claim 1, wherein at least a portion of the at least one recess does not overlap with the at least one protrusion.

6. The thrust plate according to claim 1, wherein the first side comprises two or more protrusions and wherein each of the two or more protrusions overlaps entirely with at least a portion of the at least one recess.

7. The thrust plate according to claim 1, wherein the at least one protrusion and the at least one recess form first and second patterns, respectively.

8. The thrust plate according to claim 7, wherein the first pattern overlaps entirely with the second pattern, but wherein the at least one recess extends outwardly in every in-plane direction of the plane for a distance of 1 to 2 mm.

9. The thrust plate according to claim 1, wherein the at least one protrusion has an annular shape and wherein the at least one recess has an annular shape.

10. The thrust plate according to claim 9, wherein the first side comprises two or more protrusions, wherein the two or more protrusions form concentric rings, and/or wherein the second side comprises two or more recesses, wherein the two or more protrusions form concentric rings.

11. The thrust plate according to claim 1, wherein each of the at least one protrusion is formed by a bar, which extend radially from a center of the disk-shaped body and wherein each of the at least one recess is formed by a groove, which extend radially from the center of the disk-shaped body, the number of the plurality of bars and the number of the plurality of grooves being the same.

12. A system comprising:

a thrust plate comprising:

a disk-shaped body defining a plane and having a first side and a second side, wherein the second side opposes the first side, wherein the disk-shaped body comprises a plurality of holes, which extend from a surface of the first side to a surface of the second side and which are configured to receive pins of an Oldham coupling, and at least one protrusion extending from the first side; and an orbiting scroll plate having a base plate with a frontside and a backside, wherein the orbiting scroll plate comprises at least one recess located at its backside;

wherein the backside of the orbiting scroll plate at least partially abuts at least a portion of the second side of the thrust plate, and wherein the at least one protrusion and the at least one recess overlap at least partially in a direction perpendicular to the plane, wherein the at least partial overlap is defined by the at least one protrusion overlapping entirely with the at least one recess.

13. A scroll compressor comprising: either the thrust plate according to claim 1 and an orbiting scroll plate or the system of the orbiting scroll plate and the thrust plate according to claim 12.

* * * * *